US009574462B2

(12) United States Patent
Bauer et al.

(10) Patent No.: US 9,574,462 B2
(45) Date of Patent: Feb. 21, 2017

(54) METHOD FOR OPERATING A POWER PLANT INSTALLATION

(71) Applicant: Siemens Aktiengesellschaft, Munich (DE)

(72) Inventors: Gunter Bauer, Herzogenaurach (DE); Norbert Pieper, Dinslaken (DE); Hans-Ulrich Thierbach, Wiehl (DE); Michael Wechsung, Mulheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 165 days.

(21) Appl. No.: 14/388,553

(22) PCT Filed: Mar. 27, 2013

(86) PCT No.: PCT/EP2013/056496
§ 371 (c)(1),
(2) Date: Sep. 26, 2014

(87) PCT Pub. No.: WO2013/149900
PCT Pub. Date: Oct. 10, 2013

(65) Prior Publication Data

US 2015/0113989 A1 Apr. 30, 2015

(30) Foreign Application Priority Data

Apr. 4, 2012 (EP) ..... 12163194

(51) Int. Cl.
*F01K 7/34* (2006.01)
*F01K 3/26* (2006.01)
(Continued)

(52) U.S. Cl.
CPC ..... *F01K 3/262* (2013.01); *F01K 7/025* (2013.01); *F01K 7/22* (2013.01); *F01K 7/24* (2013.01); *F01K 13/02* (2013.01)

(58) Field of Classification Search
CPC ..... F01K 13/02; F01K 3/262; F01K 7/025; F01K 7/22; F01K 7/24
See application file for complete search history.

(56) References Cited

U.S. PATENT DOCUMENTS 3,894,394 A 7/1975 Braytenbah
4,132,076 A 1/1979 Weiss
(Continued)

FOREIGN PATENT DOCUMENTS

CN 87101723 A 9/1987
CN 101287892 A 10/2008
(Continued)

OTHER PUBLICATIONS

JP Notice of Allowance dated Jul. 4, 2016, for JP application No. 2015-503823.

*Primary Examiner* — Jesse Bogue
(74) *Attorney, Agent, or Firm* — Beusse Wolter Sanks & Maire

(57) ABSTRACT

The invention relates to a method for operating a power plant, wherein in partial load operation the increase of temperature results at the outlet of the high-pressure turbine section as a consequence of a throttling by means of the intermediate pressure valve.

15 Claims, 1 Drawing Sheet

(51) Int. Cl.

| | |
|---|---|
| ***F01K 7/22*** | (2006.01) |
| ***F01K 7/24*** | (2006.01) |
| ***F01K 13/02*** | (2006.01) |
| ***F01K 7/02*** | (2006.01) |

(56) References Cited

U.S. PATENT DOCUMENTS

| | | | | |
|---|---|---|---|---|
| 4,166,221 | A | 8/1979 | McGaha | |
| 4,253,308 | A | 3/1981 | Callan | |
| 4,744,723 | A | 5/1988 | Hashimato et al. | |
| 5,347,814 | A * | 9/1994 | Kemmer | F01K 7/22 60/676 |
| 5,361,585 | A * | 11/1994 | Westphal | F01K 7/24 60/646 |
| 6,141,956 | A | 11/2000 | Imai | |
| 7,765,807 | B2 | 8/2010 | Diesterbeck et al. | |
| 8,713,941 | B2 | 5/2014 | Glos | |
| 2004/0013511 | A1 * | 1/2004 | Brackenhammer | F01K 7/22 415/1 |
| 2009/0136337 | A1 | 5/2009 | Boss et al. | |
| 2009/0249788 | A1 * | 10/2009 | Diesterbeck | F01D 25/10 60/646 |
| 2010/0236240 | A1 * | 9/2010 | Hu | F01K 13/02 60/653 |

FOREIGN PATENT DOCUMENTS

| | | | |
|---|---|---|---|
| CN | 101622424 | A | 1/2010 |
| DE | 102008037579 | A | 5/2009 |
| DE | 102010041627 | A | 3/2012 |
| EP | 0236959 | A2 | 9/1987 |
| EP | 0899505 | A2 | 3/1999 |
| JP | S5225240 | A | 2/1977 |
| JP | S53120606 | U | 9/1978 |
| JP | S6226303 | A | 2/1987 |
| JP | S62026303 | A | 2/1987 |
| JP | S63248903 | A | 10/1988 |
| WO | 2012041649 | A2 | 4/2012 |

* cited by examiner

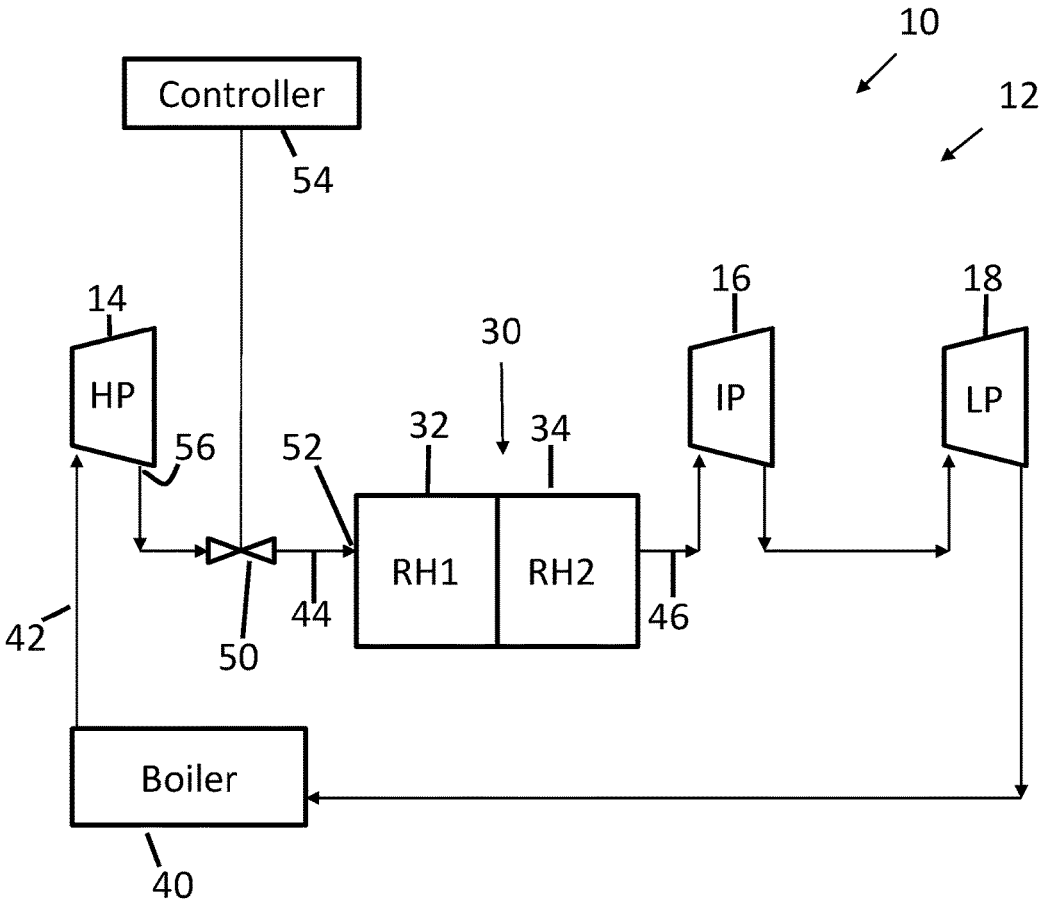
10
12
Controller
54
14
HP
56
52
32
30
34
16
IP
18
LP
RH1
RH2
44
46
42
50
Boiler
40

METHOD FOR OPERATING A POWER PLANT INSTALLATION

CROSS REFERENCE TO RELATED APPLICATIONS

This application is the U.S. National Stage of International Application No. PCT/EP2013/056496 filed Mar. 27, 2013, and claims the benefit thereof. The International Application claims the benefit of European Application No. EP12163194 filed Apr. 4, 2012. All of the applications are incorporated by reference herein in their entirety.

FIELD OF INVENTION

The invention relates to a method for operating a power plant installation comprising a steam turbine which is subdivided into a high-pressure turbine section, an intermediate-pressure turbine section and a low-pressure turbine section, and in which a reheater unit is arranged between the high-pressure turbine section and the intermediate-pressure turbine section.

The invention further relates to a power plant operated according to the method according to the invention.

BACKGROUND OF INVENTION

Power plant installations, in which large-volume steam turbines are used, are used inter alia for the local supply of power. The steam turbines used in such power plants have relatively high masses and are generally configured for a predefined rated power. These power plants, which may also be termed conventional power plants, may in a first approximation be split into pure steam power plants on one hand and gas and steam power plants on the other. Both share the fact that fossil fuels are required in order to generate electrical energy. Such power plants were hitherto conceived and configured for a base load. As a consequence of the increasing proportion of renewable energy sources—such as wind energy—which are largely impossible to control, the abovementioned conventional power plants must ever more frequently be operated at partial load. This means that the power plants do not supply the rated power for long periods, but rather supply a percentage of the rated power as partial load. The partial loads may, in some cases, be for example 25% of the full load.

This means that these power plants must be operated flexibly, wherein the change from comparatively low partial load to full load should occur as quickly as possible and without there being a limit on the number of load changes. The problem with that is that the temperature of the steam leaving the reheater unit drops markedly under extreme partial load, such as 25%, due to the lower availability of heat from the cooler flue gas. This temperature drop can be up to 60° Kelvin. However, these temperature variations are also transmitted to the components. This means that, in less-than-ideal cases, the voluminous and massive components have to be constantly heated and cooled. Thick-walled components in particular, such as an intermediate-pressure turbine section shaft, may be heated only comparatively slowly while observing desired changes in load. However, this runs counter to the requirement of switching the power plant from extreme partial load to full load in the shortest possible time.

For this reason, the reheater heating surfaces have hitherto been oversized and the hot reheater temperature in the upper load region, for example between 70% and 100%, has been controlled taking into account the thermodynamic efficiency losses resulting therefrom. The hot reheater temperature, which prevails downstream of the reheater unit, is referred to as "hRH". A further approach consists in imposing appropriate limits on the load gradients in the lower load region, or in reducing the permissible load changes, wherein increased wear is also taken into account, such that the thick-walled components have to be exchanged early.

SUMMARY OF INVENTION

This is the starting point for the invention. The invention has an object of operating the power plant such that the service life of the components is increased in spite of frequent load changes. This object is achieved by means of a method for operating a power plant installation comprising a steam turbine which is subdivided into a high-pressure turbine section, an intermediate-pressure turbine section and a low-pressure turbine section, and in which a reheater unit is arranged between the high-pressure turbine section and the intermediate-pressure turbine section, having the steps of: —operating the power plant installation at partial load, —raising the temperature at the inlet to the reheater unit by throttling a valve arranged upstream of the intermediate-pressure turbine section.

This object is further achieved by means of a power plant operated according to a method as claimed, and further by means of a power plant which is configured as a steam power plant or as a gas and steam power plant, and is operated according to the method according to the invention.

Advantageous developments are indicated in the subclaims.

The invention proceeds from the consideration that, as before, a frequent load change can occur but that this will not lead to a shortening of the component service life. The invention is based on the consideration that, in general in the case of identical temperature gradients, the number of permissible load changes is not proportional to the temperature step change. For example, a temperature step change of 30° Kelvin leads to approximately 1 000 000 permissible load changes, whereas a temperature step change of 60° Kelvin does not lead to the permissible load changes being halved, but to a much lower number of load changes, specifically approximately 10 000 permissible load changes. Thus, doubling the temperature step change changes the number of permissible load changes by one or more orders of magnitude. The abovementioned values are purely demonstrative. The number of permissible load changes, as a function of the temperature step change, depends strongly on the geometries of the components, on the material properties and on the temperature, as well as on many other parameters.

One feature essential to the invention is that the temperature of the reheater unit can be reduced by raising the inlet temperature in the reheater unit. The inlet temperature upstream of the reheater unit is also termed cold reheat. Raising the temperature in this manner is achieved by throttling control valves which are arranged upstream of the second expansion section, that is to say upstream of the intermediate-pressure turbine section. The throttling reduces the expansion and thereby the temperature drop in the first expansion section, in this case the high-pressure turbine section. The consequence of this is increased load-dependent temperature variations at the outlet from the high-pressure turbine section.

Thus, the drop in hot reheater temperature which occurs under partial load is reduced by raising the cold reheater temperature at the high-pressure turbine section outlet. This temperature rise is achieved by throttling the valves so as to raise the pressure in the reheater system in a targeted manner during partial load. If no throttling takes place, then in the event of partial load a temperature change of 60° Kelvin would arise at one point, for example at one component. By virtue of the throttling according to the invention, this temperature drop of 60° Kelvin is counteracted and, for example, reaches only a temperature drop of 30° Kelvin, wherein this temperature drop of 30° Kelvin is shared between two components. The permissible load changes are thus increased by more than one order of magnitude.

Thus, splitting large temperature changes at the components in the hot reheater system and the intermediate-pressure steam turbine into small temperature changes at the components in the cold reheater and hot reheater components leads overall to smaller temperature changes at all components in the system.

In an advantageous development, the throttling is chosen such that the magnitude of the temperature drop downstream of the reheater unit in the unthrottled state is substantially halved.

The throttling is thus controlled such that, in the event of load changes, the resulting smaller temperature changes are, in a first approximation, of equal magnitude at all components. An essential advantage of the invention resides in the fact that it is henceforth possible to manage large load changes with substantially faster gradients and substantially more frequently in the service life of the steam turbine. This leads to an overall increase in service life.

BRIEF DESCRIPTION OF THE DRAWINGS

Details of embodiments of the invention are described with reference to the sole FIGURE, which shows a schematic of the power plant disclosed herein.

DETAILED DESCRIPTION OF INVENTION

An exemplary embodiment of the invention will now be described below in more detail. Conventional power plants 10 comprise a steam turbine 12 which can be subdivided into a high-pressure turbine section 14, an intermediate-pressure turbine section 16 and a low-pressure turbine section 18, and a reheater unit 30 having a first reheater 32 and a second reheater 34, wherein the reheater unit 30 is arranged between the high-pressure turbine section 14 and the intermediate-pressure turbine section 16. Upstream of the high-pressure turbine section 14, a boiler 40 generates hot fresh steam 42 which flows through the high-pressure turbine section 14 after which it is called cold reheat steam 44, and is then reheated in the reheater unit 30 to become hot reheat steam 46 before flowing into the intermediate-pressure turbine section 16 and then through the low-pressure turbine section 18. After the low-pressure turbine section 18, the steam condenses to water and is fed by means of pumps back to the boiler 40 where it is again converted into steam. Such a power plant installation is designed for a rated power and should be operated as permanently as possible at this rated power level. In partial load operation, meaning that the power plant installation is operated not at 100% of the rated load but for example at 25% of the rated load, the temperatures in the reheater unit 30 change. The temperature drops. A control valve 50 is arranged upstream of the intermediate-pressure turbine section 16 and is throttled during partial load operation such that the temperature rises at the 52 inlet to the reheater unit 30. This means that a controller 54 controls the intermediate-pressure valve 50 such that the steam flow is throttled such that the expansion in the high-pressure turbine section 14 is reduced. This reduction raises the temperature at the outlet 56 from the high-pressure turbine section 14.

The invention claimed is:

1. A method for operating a power plant installation comprising a steam turbine which is subdivided into a high-pressure turbine section, an intermediate-pressure turbine section and a low-pressure turbine section, and in which a reheater unit is arranged between the high-pressure turbine section and the intermediate-pressure turbine section, the method comprising:

operating the power plant installation during a transition from a rated load to partial load, expanding steam in the high-pressure turbine section;

delivering expanded steam to the reheater unit; and raising a temperature at an inlet to the reheater unit by throttling a valve arranged upstream of the intermediate-pressure turbine section and downstream of the high-pressure turbine section.

2. The method as claimed in claim 1, wherein the throttling is carried out such that expansion in the high-pressure turbine section is reduced.

3. The method as claimed in claim 1, wherein the throttling is chosen such that a magnitude of a temperature drop downstream of the reheater unit is halved when compared to a temperature drop that would occur if the valve were not throttled.

4. The method as claimed in claim 1, further comprising raising a temperature at an outlet of the high-pressure turbine section by an amount, and raising a temperature at an outlet of the reheater unit by the same amount.

5. The method as claimed in claim 1, wherein the partial load operation is carried out between 20% and 40% of a rated load.

6. A power plant operated according to the method as claimed in claim 1.

7. The power plant as claimed in claim 6, wherein the power plant is configured as a steam power plant.

8. The power plant as claimed in claim 6, wherein the power plant comprises an exhaust gas boiler that generates steam for the steam turbine.

9. The method as claimed in claim 1, wherein the partial load operation is carried out at 25% of a rated load.

10. A method for operating a power plant installation comprising a steam turbine which is subdivided into a high pressure turbine section, an intermediate pressure turbine section and a low pressure turbine section, and in which a reheater unit is arranged between the high pressure turbine section and the intermediate pressure turbine section, the method comprising:

operating the power plant installation at partial load, while: delivering cold reheat steam from the high pressure turbine section, through a throttle valve, and to the reheater unit; reheating the cold reheat steam to form hot reheat steam in the reheater unit; delivering the hot reheat steam from the reheater unit to the intermediate pressure turbine section;

wherein during a transition from a rated load to the partial load a temperature drop of steam entering the intermediate pressure turbine section occurs;

the method further comprising reducing an amount of the temperature drop by increasing a temperature of the cold reheat steam exiting the high pressure turbine section when compared to a temperature of the cold reheat steam exiting the high pressure turbine section at the rated load.

11. The method as claimed in claim 10, further comprising increasing the temperature of the cold reheat steam exiting the high pressure turbine section by throttling the throttle valve.

12. The method as claimed in claim 10, wherein the intermediate pressure section is one component and the reheater unit comprises at least one component, the method further comprising:

distributing the temperature drop among the reheater unit and the intermediate pressure section so that each component experiences a respective per-component temperature drop, and selecting the respective per-component temperature drop for a respective component selected based on a parameter of the respective component.

13. The method as claimed in claim 12, wherein the parameter of the respective component comprises at least one of a thickness of the respective component and a geometry of the respective component.

14. The method as claimed in claim 12, wherein the reheater unit comprises a cold reheater component and a hot reheater component.

15. The method as claimed in claim 10 wherein the intermediate pressure section is one component and the reheater unit comprises at least one component, the method further comprising:

distributing the temperature drop among the reheater unit and the intermediate pressure section so that each component experiences a respective per-component temperature drop, and selecting the respective per-component temperature drops to be equal to each other.

* * * * *